United States Patent [19]

Frye

[11] Patent Number: 4,606,647

[45] Date of Patent: Aug. 19, 1986

[54] PIN MIXER

[76] Inventor: James A. Frye, c/o Los Alamos Technical Associates, Inc., P.O. Box 410, Los Alamos, N. Mex. 87544

[21] Appl. No.: 641,747

[22] Filed: Aug. 17, 1984

[51] Int. Cl.[4] ..... B01F 15/02; B01F 7/08

[52] U.S. Cl. ..... 366/150; 366/193; 366/325; 366/331

[58] Field of Search ..... 366/325, 326, 327, 329, 366/192, 193, 279, 291, 292, 297, 299, 301, 167, 302, 150, 306, 168, 349, 331, 64, 310, 312; 277/3, 135, DIG. 1, DIG. 4, DIG. 5

[56] References Cited

U.S. PATENT DOCUMENTS

| | | | |
|---|---|---|---|
| 1,914,459 | 6/1933 | Reider | 366/329 |
| 2,587,127 | 2/1952 | Erickson | 366/310 |
| 3,090,606 | 5/1963 | Burnet | 366/326 |
| 3,244,408 | 4/1966 | Brownlie | 366/326 |
| 3,415,494 | 12/1968 | Fisher | 366/326 |
| 3,807,702 | 4/1974 | Grillo | 366/327 |
| 3,825,233 | 7/1974 | Henderson | 366/327 |
| 4,128,052 | 12/1978 | Mueller | 366/325 |

*Primary Examiner*—Robert W. Jenkins

*Attorney, Agent, or Firm*—Laney, Dougherty, Hessin, Claro & Beavers

[57] ABSTRACT

A pin mixer for mixing particulate solids having a rotor with a plurality of radially extending pins removably attached thereto. The pins form a plurality of axially and angularly staggered helices along the rotor, and pins adjacent the inlet of the mixer are interconnected by a solid ribbon. Adjustable fluid nozzles are provided in the inlet for mixing fluids with the solid particulate material. The pin mixer has a pair of bearings, a pair of seals located inwardly from the bearings, and a pair of discs attached to the rotor thereof. A first pressure source may be connected between each bearing and seal to assure that leakage across the seals is away from the bearings, and a second pressure source connected between each seal and respective disc so that leakage between the disc and shell is away from the seals. The rotor has a pair of detachable stub shafts, and a means is provided to quickly change the rotor and shell without disturbing the connection to the power source. A baffle adjacent the outlet, and a baffle adjacent a vent opposite an outlet, provide a means for varying the flow rate through the apparatus to vary the amount of mixing therein. The baffles are externally adjustable.

41 Claims, 8 Drawing Figures

PIN MIXER

BACKGROUND OF THE INVENTION

1. Field of the Invention

This invention relates to devices for mixing particulate solids, and more particularly, to a pin mixer having a rotor with a plurality of radially extending pins for mixing the particulate solid material and for transporting the material through the apparatus.

2. Description of the Prior Art

Pin mixers for mixing particulate solids generally have helically disposed pins attached to a rotor. An example of such an apparatus is disclosed in U.S. Pat. No. 3,787,161 to Frye et al., in which the pins form a double helix on the rotor with the pins of one helix axially staggered with respect to the other. While the apparatus of the present invention utilizes pins arranged to form a plurality of helices which are axially staggered, the pins in the present invention are also angularly staggered which has proven to increase contact of the material by the moving pins for better mixing and transport through the apparatus. Another patent showing two axially staggered helices is U.S. Pat. No. 3,011,876 to Raistrick.

The pin mixer of Driscoll, shown in U.S. Pat. No. 3,636,188 utilizes an inwardly extending dam adjacent the outlet. The pin mixer of the present invention has an externally adjustable baffle adjacent the outlet and another adjustable baffle opposite the first baffle. Thus, the area between the baffles and the rotor can be varied depending upon the mixing time desired within the apparatus. This is distinguishable from Driscoll which has a stationary dam. U.S. Pat. No. 2,920,344 to Stirling shows a plurality of radially extending baffles projecting inwardly in a mixing apparatus. The baffles are spaced longitudinally along the apparatus, and are not externally adjustable as are the baffles of the present invention.

U.S. Pat. No. 3,163,403 to Engels discloses a mixing machine having a disc attached to, and rotatable with, a shaft, which disc is used to retain a substantial portion of the material to be mixed near the circumference of the outer shell of the apparatus. The discs attached to the rotor of the pin mixer of the present invention are distinguishable in their function in that they are utilized in conjunction with a pressure source to assure that leakage through the apparatus is away from shaft seals. Further, the pressure acts to keep material from collecting around the outer peripheral edge of the discs.

SUMMARY OF THE INVENTION

The pin mixer of the present invention has an enclosure formed by a tubular shell with a drive end bearing housing on one end and an outboard end bearing housing on the other end. Material enters through an inlet which has a plurality of fluid nozzles therein which are used to mix fluid with the material as it enters the apparatus. The nozzles are axially adjustable, radially adjustable with respect to the shell, and also the pressure provided to the nozzles is variable. Thus, the amount of fluid and mixing in the inlet may be adjusted as desired. The inlet also has a deflector plate therein to prevent particulate material from being thrown back into the inlet nozzle after it enters the apparatus.

Rotatably disposed in the shell is a rotor having a plurality of radially extending pins removably attached thereto. The pins are located on the rotor to form a plurality of helices. The pins of each helix are angularly and axially staggered with respect to the pins of the other helices. In the preferred embodiment, two such helices are used. A plurality of pins adjacent the inlet are joined at their radially outer end by a solid ribbon. The ribbon acts to support the pins and also helps prevent blockage of particulate material as it enters the shell. In a first embodiment, the rotor has a solid cross section, and in a second embodiment, the rotor is hollow having a plurality of pin lugs attached thereto. The rotor has a detachable drive end stub shaft on one end thereof and a detachable outboard end stub shaft on the other end.

In each bearing housing is a rotary bearing and a shaft seal inwardly disposed with respect to the bearing. A pressure source may be connected between each bearing and seal such that any leakage by the seal is away from the bearing. Attached to each end of the rotor, and rotatable therewith, is an annular disc. The discs are located axially inwardly with respect to the seals, and a second pressure source may be connected between each seal and the corresponding disc such that any leakage between the disc and an inner surface of the shell is away from the seal. In the preferred embodiment, the second pressure source has a pressure level less than that of the first pressure source. Thus, the amount of particulate material that reaches the seal is minimized, and such material is kept away from the bearings.

The bearing housings each have a mounting foot for mounting to a support surface, and at least the outboard bearing housing utilizes a slot so that it may be moved axially away from the shell after removing the appropriate fasteners. Support means, slidable with respect to the outboard bearing housing, act to support the shell when the outboard bearing housing is removed therefrom. The outboard shaft stub may then be removed from the rotor. The drive end bearing housing is then detached from the shell, and the shell is moved along the support means toward the outboard bearing housing so that the drive end stub shaft may be removed from the rotor. The shell and rotor therein may then be lifted away from the bearing housing for quickly changing the rotor or for installing different diameter shells and rotors. The pin mixer does not have to be disconnected from its power source.

Located in the outlet of the appparatus is a radially and externally adjustable baffle plate. A vent opposite the outlet has a similar baffle plate. By radially adjusting the baffles, the discharge flow rate may be adjusted. This provides a means for increasing the mixing time within the apparatus.

An object of the present invention is to provide a pin mixer having a rotor with an improved pin placement thereon.

Another object of the invention is to provide a reinforcement for the pins on the rotor of a pin mixer adjacent the inlet thereof.

An additional object of the invention is to provide a pin mixer wherein leakage across the shaft seals is away from the bearings.

A further object of the invention is to provide a means for quickly changing the rotor of a pin mixer without disturbing the connection thereof to a power source.

Another object of the invention is to provide an adjustable means of mixing fluid with solid particulate material in the inlet of a pin mixer.

Still another object of the present invention is to provide an externally adjustable means to stop or adjust the flow rate of material through the apparatus to provide additional mixing time therein.

Additional objects and advantages of the invention will become apparent as the following detailed description of the preferred embodiments is read in conjunction with the accompanying drawings which illustrate such preferred embodiments.

DETAILED DESCRIPTION OF THE PREFERRED EMBODIMENT

Figure 1:
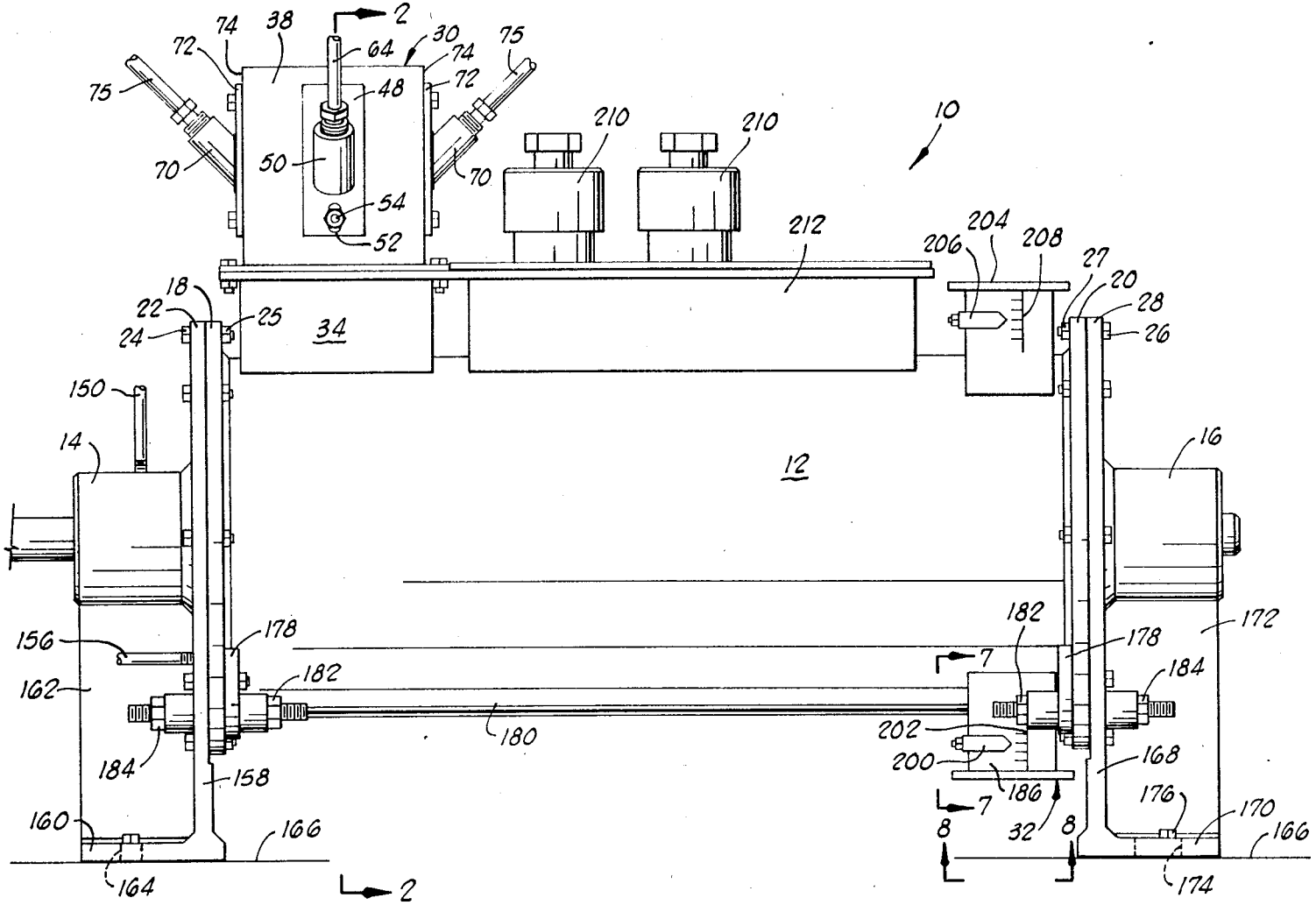
FIG. 1 is a side elevational view of a pin mixer of the present invention.

Referring now to the drawings and particularly to FIG. 1, the pin mixer of the present invention is generally designated by the numeral 10. The apparatus has an enclosure formed by a substantially tubular shell 12, a drive end bearing housing 14 and an outboard end bearing housing 16. Shell 12 has a first end flange 18 and a second end flange 20. Drive end bearing housing 14 has a flange 22 which is removably attached to flange 18 of shell 12 by means of bolts 24 and nuts 25. Similarly, outboard end bearing housing 16 has a flange 28 removably attached to flange 20 of shell 12 by bolts 26 and nuts 27. Material enters the apparatus through an inlet 30 and exits through an outlet 32.

Figure 2:
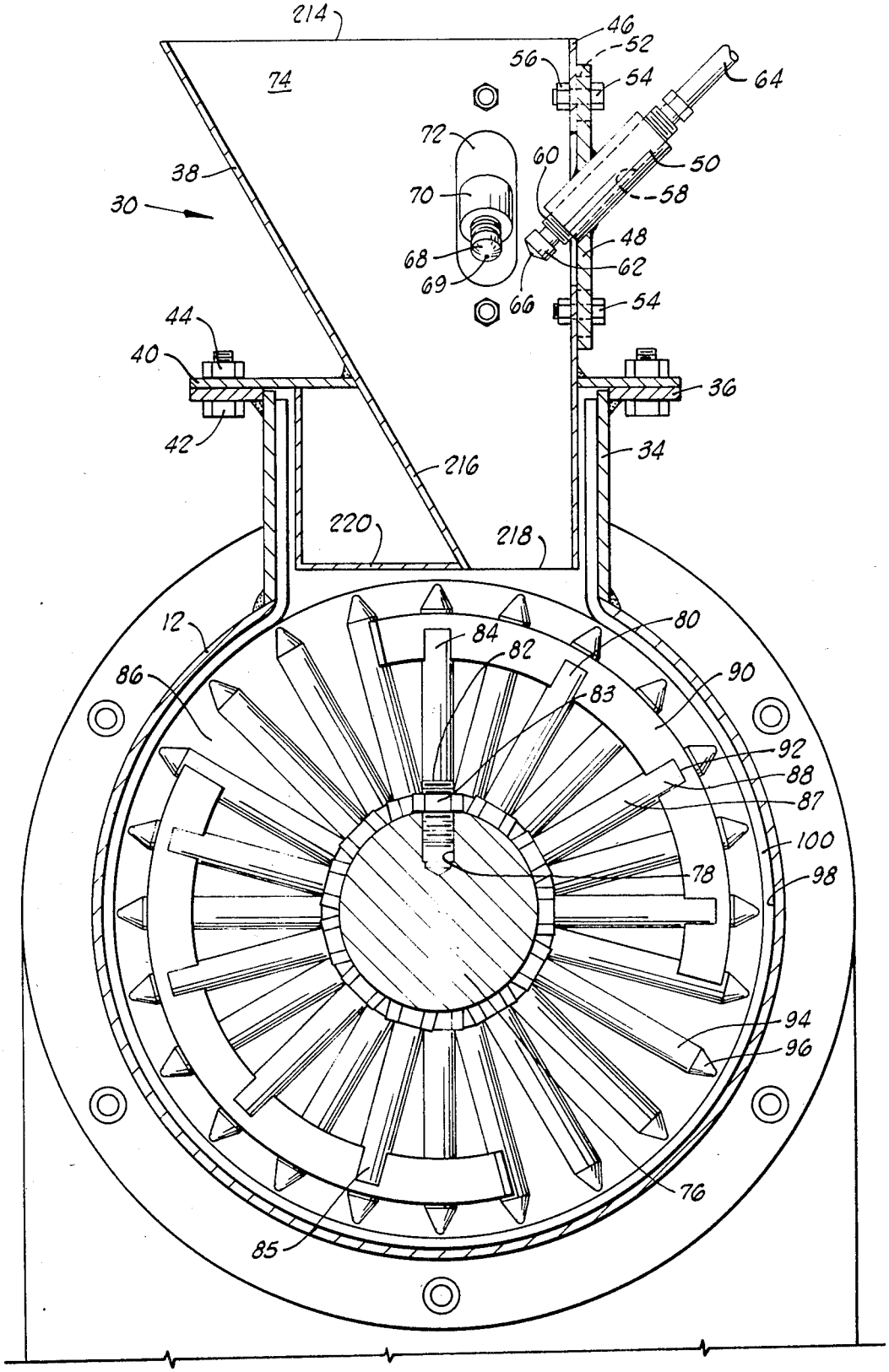
FIG. 2 is a cross section taken along line 2—2 in FIG. 1 showing a detail of the inlet of the pin mixer apparatus and a first embodiment of the rotor used in the apparatus.

Inlet 30 includes a neck 34 extending radially from shell 12 with an outwardly extending flange 36 and an inlet hopper 38 having a flange 40 as shown in FIG. 2. Flange 40 is attached to flange 36 by bolts 42 and nuts 44. Hopper 38 has a substantially vertical wall 46 to which is attached a nozzle plate 48 having a nozzle housing 50 fixedly attached thereto. Nozzle plate 48 has a plurality of vertically oriented slots 52 therein through which pass bolts 54 which are held in place by nuts 56 on the inside of wall 46 of hopper 38. Nozzle housing 50 defines an internally threaded opening 58 in which is threadingly engaged a threaded outer surface 60 of fluid nozzle 62. Fluid is provided to nozzle 62 through tube 64 and exits the nozzle through an open aperture 66. Similarly, nozzles 68 having an aperture 69 therein are mounted in nozzle housing 70 attached to nozzle plates 72. Nozzle plates 72 are slidingly attached to vertical wall 74 of hopper 38 at right angles to vertical wall 46 of the hopper. Fluid is provided to nozzles 68 through tubes 75.

It can be seen that the threaded engagement between nozzle 62 and nozzle housing 50 provides a nozzle axial adjustment means for axially advancing the nozzle toward inlet 30 and retracting the nozzle from the inlet by rotating the nozzle in the housing. As can be seen from FIG. 1, as well as FIG. 2, bolts 54 may be loosened so that nozzle plate 48 can be vertically moved along slots 52 with respect to hopper 38, thus providing a radial adjustment means for nozzle 62 in relationship to inlet 30 and shell 12. Nozzles 68 have similar radial adjustment means. If tubes 64 and 75 are connected to a pressure source (not shown) having a variable pressure level, the fluid flow velocity from apertures 66 and 69 is correspondingly variable, and thus a fluid flow rate adjustment means is provided.

Still referring to FIG. 2, a first embodiment of a rotor construction is shown. Rotor 76 is of cylindrical configuration having a relatively small diameter and a plurality of internally threaded radial openings 78 therein. A plurality of radially extending pins 80 having an externally threaded end 82 are engaged with openings 78 in rotor 76. Pins 80 are locked in place by lock nut 83 which jams against rotor 76.

Figure 3:
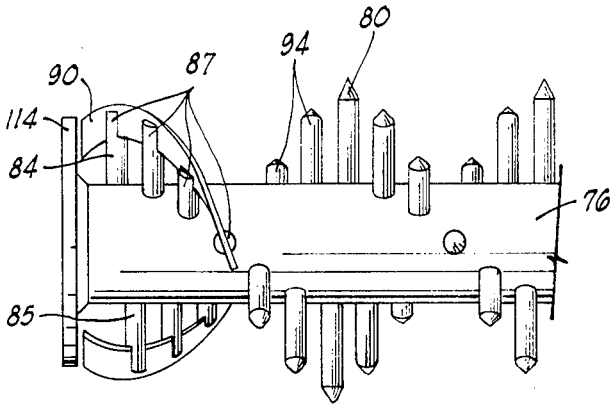
FIG. 3 is a partial longitudinal elevation of the rotor.

Referring now to FIG. 3, pins 80 are helically located around and along rotor 76 to form a plurality of helices. In the preferred embodiment, but not by way of limitation, two such helices are formed. Referring again to FIG. 2, the first pin 84 of one helix is angularly staggered with respect to the first pin 85 of the second helix, such that pin 85 of the second helix is angularly displaced with respect to adjacent pins 83 of the first helix. Preferably, the pins on each helix are substantially evenly spaced so that each entire helix is angularly staggered with respect to the other. Preferably, the angular stagger with two helices is 180° degrees plus one-half of the angular displacement of adjacent pins on a single helix. For example, but not by way of limitation, a twelve pin helix would have pins spaced at thirty-degree intervals around the shaft. In this case, with two helices, the angular displacement of one helix with respect to the other is 195 degrees, rather than the 180 degrees of previously known pin mixers. Thus, each of the pins of one helix are angularly displaced with respect to adjacent pins on the other helix, rather than aligned therewith.

Looking at the cross section of FIG. 2, taken perpendicular to the longitudinal axis of the rotor, an open area 86 is defined by shell 12, rotor 76 and pins 80. It is clear that, because of the radial stagger between the helices, open area 86 is substantially less than a corresponding open area of a conventional pin mixer with two opposite, unstaggered helices. An open area percentage may be defined by the following equation:

$$\text{Open Area Percentage} = \frac{100 \times [A1 - (A2 + A3)]}{A1}$$

where,

A1 = internal cross-sectional area of empty shell 12

A2 = cross-sectional area of rotor 76

A3 = cross-sectional area of pins 80 (as viewed in FIG. 2)

A preferable open area percentage having an approximate range of 30 to 50 percent has been empirically determined, but other open area percentages are workable.

As shown in FIG. 3, the helices formed by pins 80 on rotor 76 are also axially staggered, and each pin sweeps an annular volume in shell 12 as the rotor turns on its axis. In the preferred embodiment, but not by way of limitation, the axial spacing between adjacent pins is less than the diameter of any individual pin 80. Thus, the annular volumes swept by the pins of one helix overlap the annular volumes swept by the pins of the other helix to insure maximum contact and mixing of the particulate material by the pins.

Thus, pins 80 forming angularly and axially staggered helices thoroughly mix the material and also act as a screw conveyor or auger which moves the material from the inlet to the outlet. The reduced open area of the present invention reduces the flow rate and assures increased mixing of the material.

As can be seen in FIGS. 2 and 3, a plurality of pins 87 adjacent inlet 30 are joined at a radially outer end 88 thereof by a solid ribbon 90 which extends radially outwardly and inwardly from outer ends 88 of pins 87. This ribbon helps support pins 87 and further has the purpose of preventing blockage by particulate solid material as it enters shell 12 for mixing and transport. Radially outer end 88 of pins 87 has a flat outer surface 92 perpendicular to a radial axis thereof. The remainder of pins 80 which are not connected by ribbon 90, such as those indicated by numeral 94, have an outwardly pointing conical tip 96 adjacent inner surface 98 of shell 12 in close, spaced relationship thereto. Inner surface 98 may be optionally coated with a rubber layer 100, or any other suitable material, as shown in FIG. 2. In the preferred embodiment, the spacing between conical tip 96 and inner surface 98, or the inner surface of rubber layer 100 if such a layer is used, is approximately 1/16 to ⅛ inch.

Figure 4:
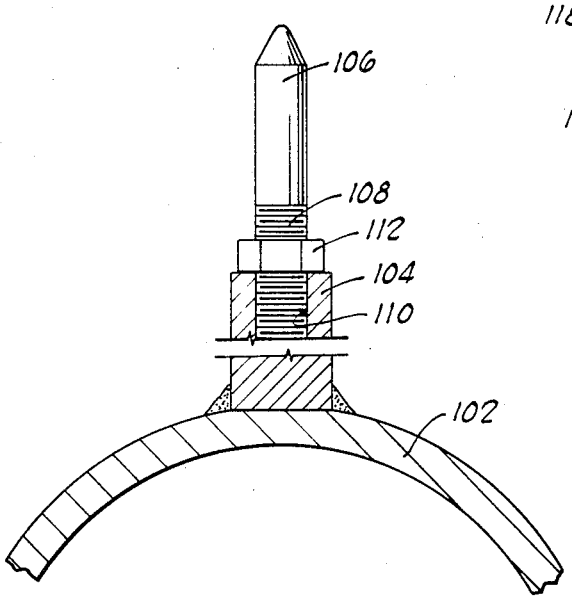
FIG. 4 is a partial cross-sectional view showing a second embodiment of the rotor.

Referring now to FIG. 4, an alternate embodiment of a relatively large diameter rotor is shown. Rotor 102 is of hollow, substantially cylindrical configuration having a plurality of pin lugs 104 extending radially therefrom and fixedly attached thereto. Pins 106 have an externally threaded end 108 which is engaged with internally threaded opening 110 of each lug 104. Pins 106 are held in place by means of lock nut 112. Lugs 104 are angularly and axially spaced and helically arranged along rotor 102 in the same manner as pins 80 on first embodiment rotor 76 illustrated in FIG. 3.

Figure 5:
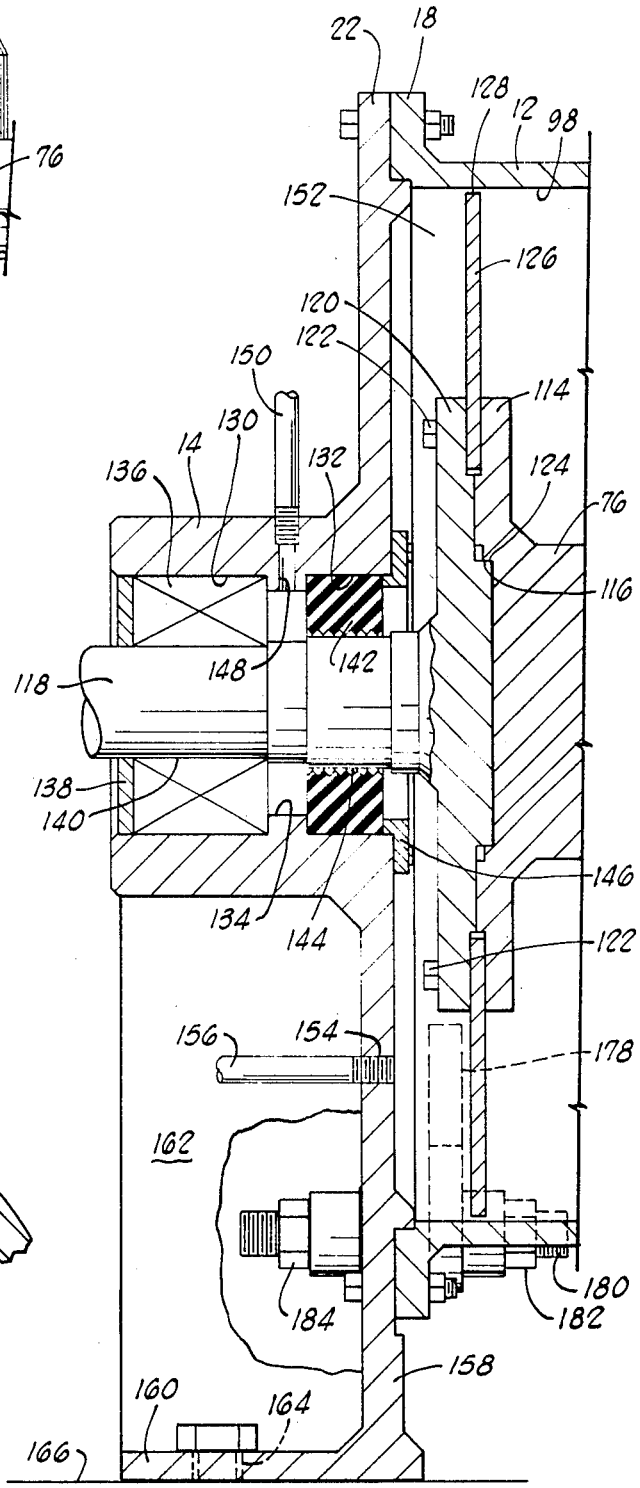
FIG. 5 is a partial vertical cross section of the apparatus showing details of the bearing housing and sealing means.

In the vertical cross section of the drive end of the apparatus shown in FIG. 5, it can be seen that rotor 76 has a radially extending flange 114 and an internal pilot bore 116. A drive end stub shaft 118 has a radially extending flange 120 attached to flange 114 of rotor 76 by bolts 122. Stub shaft 118 has an external pilot diameter 124 which fits in pilot bore 116, in close dimensional tolerance therewith, for precisely positioning shaft 118 with respect to rotor 76. An annular plate or disc 126 is positioned between flange 114 on rotor 76 and flange 120 on stub shaft 118. Plate 126 defines a radially outer surface 128 in close, spaced relationship to inner surface 98 of shell 12. Preferably, the spacing between outer surface 128 and inner surface 98 is less than approximately 1/16 inch. A similar outboard stub shaft and plate (not shown) are attached to the outboard end of rotor 76.

Bearing housing 14 has a cavity therein defining bearing bore 130, seal bore 132 and intermediate diameter 134. A rotary bearing 136 of a kind known in the art is positioned in bearing bore 130 and held in place by bearing retainer 138. Bearing 136 rotatably receives and supports bearing surface 140 of stub shaft 118. Longitudinally inwardly spaced from bearing 136 is labyrinth shaft seal 142 for sealing seal surface 144 of stub shaft 118. Seal 142 is held in place by seal retainer 146.

A hole 148 opens into intermediate diameter 134 and is connected to a pressure source by tube 150. The pressure source provides a pressure level between bearing 136 and seal 142 such that any leakage by the seal across seal surface 144 is toward rotor 76 and away from the bearing. An irregularly shaped, but substantially annular, cavity 152 is formed between plate 126 and bearing housing 14. Hole 154 opens into cavity 152 and is connected to a second pressure source by tube 156. The pressure level in cavity 152 from the second pressure source is such that any leakage between outer surface 128 of plate 126 and inner surface 98 of shell 12 is toward rotor 76 and away from bearing housing 14. The pressure level in cavity 152 is maintained below that between bearing 136 and seal 142.

Figure 6:
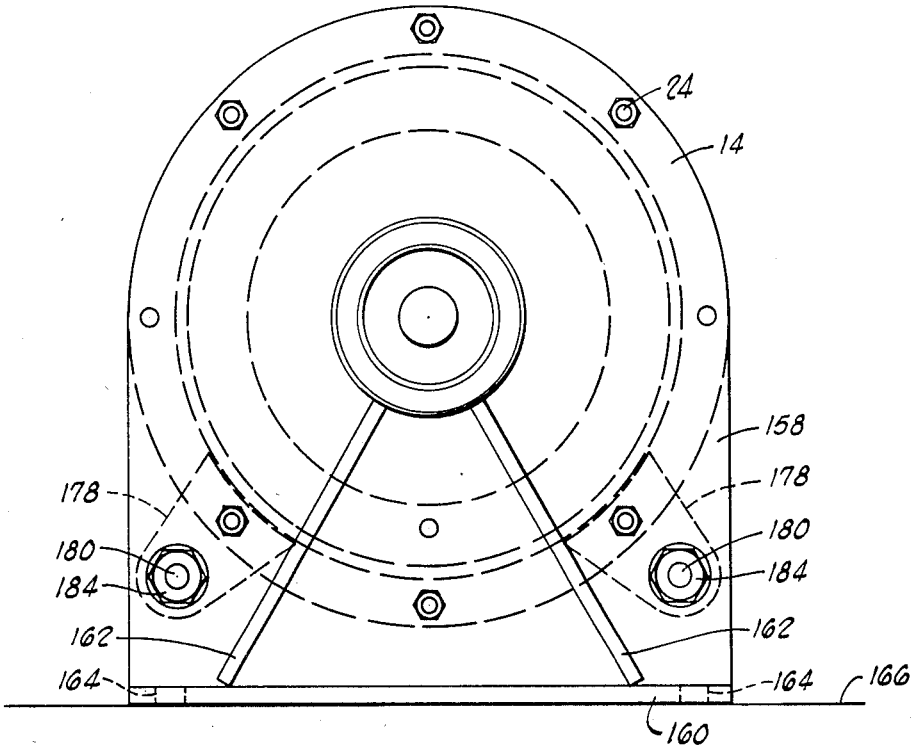
FIG. 6 is an end elevation of the pin mixer of the present invention.

Referring now to FIGS. 5 and 6, it can be seen that bearing housing 14 has a downwardly extending bracket 158 with an integrally formed foot 160 extending perpendicularly therefrom in a direction away from shell 12. Braces 162 are provided for additional support. Mounting holes 164 are provided to bolt foot 160 to a base surface 166. Referring again to FIG. 1, outboard bearing housing 16 has a similar bracket 168, mounting foot 170 and brace 172. Foot 170 has a plurality of longitudinally disposed slots 174 through each of which a bolt 176 is passed for attachment to base surface 166.

Figure 7:
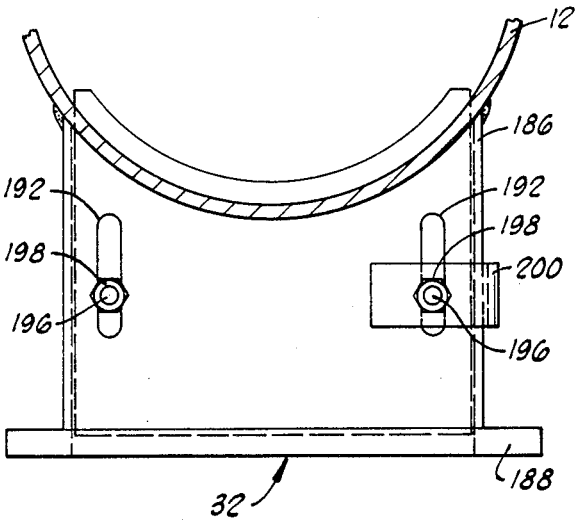
FIG. 7 is a cross section taken along line 7—7 in FIG. 1.
Figure 8:
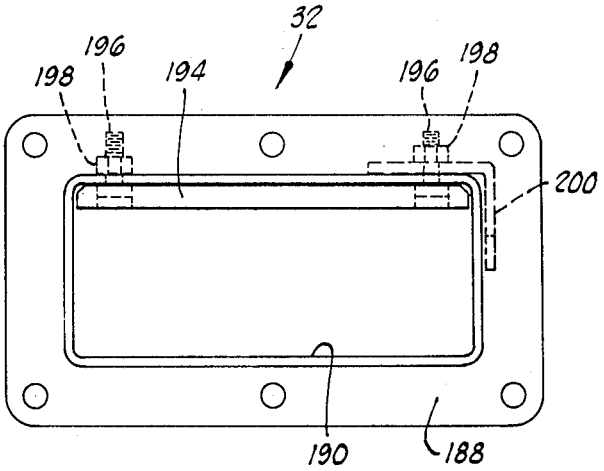
FIG. 8 is an elevation view of the outlet of the apparatus as seen from line 8—8 in FIG. 1.

By loosening bolts 176, and removing bolts 26 and nuts 27 connecting bearing housing 16 to shell 12, outboard bearing housing 16 may be slidably moved away from its operating position attached to shell 12 to a shell-removal position. Shell 12 is prevented from falling by support lugs 178 slidably mounted on support rods 180. Support lugs 178 and support rods 180 are also shown in FIGS. 5 and 6. Nuts 182 and 184 lock support lugs 178 and support rods 180 in position prior to moving outboard bearing housing 16. Once bearing housing 16 is moved away from shell 12, the bolts holding the outboard stub shaft to rotor 76 may be removed. Then, bolts 24 and nuts 25 holding drive end bearing housing 14 to shell 12 may be removed, and the shell axially moved toward outboard bearing housing 16, supported by support lugs 78 and support rods 180. The bolts 24 connecting drive end stub shaft 118 to rotor 76 may then be removed. Once this is accomplished, shell 12, and rotor 76 therein, may be lifted away from the bearing housings. Thus, the rotor may be quickly changed within shell 12, and the shell and new rotor reattached by following the previous steps in reverse order. Also, if desired, different diameter shells and rotors also may be installed in the field. With this quick-change feature, it is not necessary to disconnect drive end stub shaft 118 from the driver Referring now to FIGS. 1, 7 and 8, details of outlet 32 are shown. Outlet 32 has a neck portion 186 extending radially from shell 12 with an outwardly directed flange 188 at a lower end thereof. Neck 186 defines a central opening 190 therethrough and a pair of vertically disposed slots 192 through a wall thereof. A substantially vertically slidable baffle plate 194 is located in central opening 190 adjacent slots 192. A pair of studs 196 are attached to baffle plate 194 and extend outwardly through slots 192. Baffle plate 194 is held in place by a pair of nuts 198 threadingly engaged with studs 196. When nuts 198 are loosened, baffle plate 194 may be externally adjusted by using studs 196 as handles. An external pointer 200 attached to one of studs 196 is movable with baffle plate 194 and indicates the position of the baffle plate on a fixed scale 202 located on an outer surface of neck 186 as shown in FIG. 1.

A vent 204 is located substantially 180° from outlet 32 on shell 12 as shown in FIG. 1. Vent 204 has a similar baffle plate (not shown) with a pointer 206 indicating the baffle plate position on fixed scale 208.

Baffle plate 194 in outlet 32 and the baffle plate in vent 204 are each variably movable from a fully open operating position to a fully closed position, and each baffle may be independently lowered or raised as desired. Flow of material in the apparatus can be stopped by moving the baffle plates toward rotor 74. This allows additional mixing of the materials in shell 12 prior to discharge.

Liquid chemicals for mixing with the particulate solid material can be injected into shell 12 through liquid injectors 210 which are mounted on an injector housing 212 attached to shell 12.

In the operation of the pin mixer of the present invention, particulate solid material is fed into the apparatus through an inlet opening 214 in inlet hopper 38 as shown in FIG. 2. Atomized fluids from nozzles 62 and 68 are mixed with the particulate solid material in hopper 38. Inlet hopper 38 has an angular wall 216 which directs the mixed material into shell 12 through a narrowed opening 218 adjacent the outer tips of pins 80 on rotor 76. In FIG. 2 the rotor and shaft assembly rotates in a clockwise direction so that, as material passes through opening 218, it is carried away from inlet hopper 38 by pins 80. A deflector plate 220 prevents the particulate material from being thrown back up into inlet hopper 38 by the rotating pins.

The helical arrangement of the pins gradually forces the material toward outlet 32. Because the helices overlap, there is total mixing of the material as it is moved through shell 12. Additional chemicals are injected through liquid injectors 210 and are mixed with the material as desired. When baffle plate 194 in outlet 32 and the baffle plate in vent 204 are moved to their open positions, the material will exit the apparatus through central opening 190 of outlet 32.

It can be seen, therefore, that the pin mixer of the present invention is well adapted to carry out the objects and attain the ends and advantages mentioned, as well as those inherent therein. While a presently preferred embodiment of the invention has been described for the purposes of this disclosure, numerous changes in the construction and arrangement of parts may be made by those skilled in the art. All such changes are encompassed within the scope and spirit of this invention as defined by the appended claims.

What is claimed is:

1. An apparatus for mixing materials comprising:

an enclosure defining a cavity therein and having an inlet and an outlet;

a rotor rotatably disposed in said enclosure; and a plurality of spaced pins extending radially outwardly from said rotor and forming a plurality of helices around, and axially along, said rotor for mixing and moving said materials from said inlet to said outlet, wherein the pins forming each helix are angularly and axially staggered such that any pin on one helix is angularly displaced with respect to adjacent pins on the other helices at an angle less than the angular displacement between pins on a single helix.

2. The apparatus of claim 1 comprising two of said angularly and axially staggered helices.

3. The apparatus of claim 2 wherein a first pin of one helix is angularly displaced from a first pin of the other helix by an angle of 195 degrees.

4. The apparatus of claim 1 wherein:

an inner surface of said enclosure, said rotor and said pins define an open area therebetween in a plane extending perpendicular to a longitudinal axis of said rotor; and said open area is approximately 30 to 50 percent of an area in the same plane defined by said inner surface of an empty enclosure.

5. The apparatus of claim 1 further comprising a ribbon helically disposed in at least one of said helices, said ribbon interconnecting at least two of said pins forming said helix.

6. The apparatus of claim 1 wherein said pins are detachably engaged with said rotor.

7. The apparatus of claim 6 wherein said pins are threadingly engaged with said rotor and said apparatus further comprises lock nuts threadingly engaged with said pins for jamming against said rotor to lock said pins in an operating position with respect to said rotor.

8. The apparatus of claim 1 further comprising baffle means movably disposed in said outlet whereby said baffle means is variably movable from a fully open operating position with respect to said outlet, in which open position said baffle means is adjacent an inner surface of said cavity of said shell, to a fully closed position in which said baffle means is adjacent said rotor, such that material being mixed in said apparatus is substantially prevented from exiting said outlet.

9. The apparatus of claim 1 further comprising fluid injection means for injecting fluid into said inlet for mixing with material entering said inlet.

10. An apparatus for mixing material comprising:

an enclosure defining a cavity therein and having an inlet and an outlet;

material mixing and transport means disposed in said cavity for mixing said material in said cavity and transporting said material from said inlet to said outlet; and baffle means movably disposed in said outlet whereby said baffle means is variably movable from a fully open operating position with respect to said outlet, in which said baffle means is adjacent an inner surface of said cavity, to a fully closed position in which said baffle means is adjacent said material mixing and transport means, such that material being mixed in said apparatus is substantially prevented from exiting said outlet when said baffle means is in said closed position.

11. The apparatus of claim 10 further comprising baffle adjustment means for adjusting said operating position of said baffle means.

12. The apparatus of claim 10 further comprising indicator means for indicating said operating position of said baffle means.

13. The apparatus of claim 10 wherein said material mixing and transport means comprises a rotor rotatably disposed in said enclosure having a plurality of spaced pins extending radially outwardly therefrom, said pins forming a plurality of helices around, and axially along, said rotor for mixing and moving said material from said inlet to said outlet.

14. The apparatus of claim 10 further comprising fluid injection means for injecting fluid into said inlet for mixing with material entering said inlet.

15. An apparatus for moving substantially particulate materials comprising:

an enclosure having an inlet and an outlet and comprising:

a substantially tubular shell having two opposite ends and defining a central opening longitudinally therethrough; and bearing housings, each defining a cavity therein and each attached to one of said ends of said shell;

a rotary bearing mounted in each of said bearing housing cavities;

a rotor and shaft assembly disposed in said central opening of said shell and rotatably received in said bearing;

a seal mounted in each of said bearing housing cavities and longitudinally inwardly spaced from said bearings for sealing between said rotor and shaft assembly and said bearing; and pressure connection means in communication with a portion of each of said bearing housing cavities between said seal and said bearing therein for connecting said cavity portion to a pressure source having a sufficient pressure level whereby any leakage through said seal is away from said bearing.

16. The apparatus of claim 15 further comprising a pair of plates extending radially outwardly from each end of said rotor and shaft assembly, and rotatable therewith, and defining an outer edge in close, spaced relationship to an inner surface of said central opening of said shell, each of said plates being longitudinally, inwardly spaced from said seal and adjacent said cavity of the corresponding bearing housing.

17. The apparatus of claim 16 wherein said plates are detachable from said rotor and shaft assembly.

18. The apparatus of claim 16 further comprising a second pressure connection means in communication with a second portion of each of said bearing housing cavities between said seal and said corresponding plate for connecting said cavity second portion to a second pressure source having a pressure level such that any leakage between said plate edges and said shell inner surface is away from said seal.

19. The apparatus of claim 18 wherein said spaced relationship between said plate outer edges and said shell inner surface is such that any leakage therebetween is of sufficient velocity to prevent a build-up of material therebetween.

20. The apparatus of claim 18 wherein said first-mentioned pressure source has a greater pressure level than said second pressure source.

21. The apparatus of claim 16 wherein:

said rotor and shaft assembly comprises:

a rotor having two opposite ends;

a drive end stub shaft detachably connected to one of said rotor ends; and an outboard end stub shaft detachably connected to the other of said rotor ends; and one of said plates is disposed between said rotor and said drive end stub shaft and held thereby, and the other of said plates is disposed between said rotor and said outboard end stub shaft and held thereby.

22. The apparatus of claim 15 wherein said seals are characterized as labyrinth seals.

23. The apparatus of claim 15 wherein said rotor has a plurality of spaced pins extending radially outwardly therefrom and forming a plurality of helices around, and axially along, said rotor for mixing and moving said materials from said inlet to said outlet of said enclosure.

24. The apparatus of claim 15 further comprising baffle means movably disposed in said outlet whereby said baffle means is variably movable from a fully open operating position with respect to said outlet in which said baffle means is adjacent an inner surface of said cavity of said shell to a fully closed position in which said baffle means is adjacent said rotor such that material being mixed in said apparatus is substantially prevented from exiting said outlet.

25. The apparatus of claim 15 further comprising fluid injection means for injecting fluid into said inlet for mixing with material entering said inlet.

26. An apparatus for moving materials comprising:

a substantially tubular shell having two opposite ends and defining a central opening longitudinally therethrough;

a drive end bearing housing, defining a cavity therein, removably attached to one of said shell ends;

an outboard end bearing housing, defining a cavity therein, removably attached to the other of said shell ends;

a rotary bearing mounted in each of said bearing housing cavities;

a rotor and shaft assembly, disposed in said central opening of said shell, comprising:

a rotor having two opposite ends;

a drive end stub shaft detachably connected to one of said rotor ends and rotatably received in said drive end bearing housing; and an outboard end stub shaft detachably connected to the other of said rotor ends and rotatably received in said bearing in said outboard end bearing housing; and mounting means for mounting said bearing housings to a base surface such that at least said outboard end bearing housing may be moved from an operating position in which it is attached to said shell, to a shell-removal position in which it is detached from said shell, wherein when said drive end bearing housing is detached from said shell, said rotor is detached from said stub shaft, and said shell and said rotor therein are thereby removable from said bearing housings.

27. The apparatus of claim 26 further comprising support means for supporting said shell when said outboard bearing housing is in said shell-removal position.

28. The apparatus of claim 27 wherein said support means comprises:

a plurality of support rods connecting said drive end bearing housing with said outboard end bearing housing in all positions thereof, and slidably attached to said bearing housings; and a plurality of support lugs slidably mounted on said support rods, whereby said shell rests on said lugs when said outboard bearing housing is in said shell-removal position.

29. The apparatus of claim 26 wherein said mounting means comprises a mounting foot attached to each of said bearing housings for attachment to said base surface, and wherein said foot connected to said outboard bearing housing is slidable with respect to said base surface.

30. The apparatus of claim 26 wherein said rotor has a plurality of spaced pins extending radially outwardly therefrom and forming a plurality of helices around, and axially along, said rotor for mixing and moving said materials through said enclosure.

31. An apparatus for mixing materials comprising:
an enclosure defining a cavity therein and having an inlet and an outlet;
a rotor rotatably disposed in said enclosure;
a plurality of spaced pins extending radially outwardly from said rotor and forming a plurality of helices around, and axially along, said rotor for mixing and moving said materials from said inlet to said outlet, wherein the pins forming each helix are radially and axially staggered with respect to the pins forming the other helices; and
a ribbon helically disposed in at least one of said helices, said ribbon interconnecting at least two of said pins forming said helix, wherein:
said pins interconnected by said ribbon define a radially outer end extending substantially perpendicular to a radial axis thereof;
said ribbon extends radially outwardly and inwardly from said outer ends of said interconnected pins; and
said pins not connected by said ribbon define a radially outer end having an outwardly directed conical tip.

32. The apparatus of claim 31 wherein said conical tips are in close, spaced relationship to an inner surface of said cavity in said shell.

33. An apparatus for mixing materials comprising:
an enclosure defining a cavity therein and having an inlet and an outlet, said outlet comprising a neck having a central opening therethrough and extending outwardly from said enclosure;
material mixing and transport means disposed in said cavity for mixing said materials in said cavity and transporting said material from said inlet to said outlet;
baffle means movably disposed in said outlet whereby said baffle means is variably movable from a fully open operating position with respect to said outlet in which said baffle means is adjacent an inner surface of said cavity to a fully closed position in which said baffle means is adjacent said material mixing and transport means; and
baffle adjustment means for adjusting said operating position of said baffle means, said baffle adjustment means comprising:
a handle extending externally from said nozzle; and
retaining means for retaining said baffle in said operating position.

34. An apparatus for mixing materials comprising:
an enclosure defining a cavity therein and having an inlet and an outlet;
material mixing and transport means disposed in said cavity for mixing said material in said cavity and transporting said material from said inlet to said outlet;
baffle means movably disposed in said outlet whereby said baffle means is variably movable from a fully open operating position with respect to said outlet in which said baffle means is adjacent an inner surface of said cavity to a fully closed position in which said baffle means is adjacent said material mixing and transport means; and
indicator means for indicating said operating position of said baffle means, said indicator means comprising:
a calibrated, fixed scale on an outer surface of said enclosure adjacent said outlet thereof; and
a pointer attached to said baffle means, and movable therewith, for pointing to a position on said scale corresponding to said operating position of said baffle means.

35. An apparatus for mixing materials comprising:
an enclosure defining a cavity therein and having an inlet and an outlet;
material mixing and transport means disposed in said cavity for mixing said material in said cavity and transporting said material from said inlet to said outlet;
baffle means movably disposed in said outlet whereby said baffle means is variably movable from a fully open operating position with respect to said outlet and which said baffle means is adjacent an inner surface of said cavity to a fully closed position in which said baffle means is adjacent said material mixing and transport means; and
a vent substantially radially opposite said outlet, said vent comprising a second baffle means movably disposed in said vent whereby said second baffle means is variably movable from a fully open operating position with respect to said outlet and which said second baffle means is adjacent said inner surface of said cavity to a fully closed position in which said second baffle means is adjacent said material mixing and transport means and also adjacent said baffle means in said outlet.

36. A method of mixing particulate materials comprising:
feeding solid materials to be mixed substantially radially into an annular space;
concurrently mixing fluid with the materials;
moving the materials axially in the annular space by rotating a series of helically arrayed pins through the annular space to impact, mix and move the solid materials and fluids;
adding additional fluids to said solid materials as said solid materials are moved axially in said annular space; and
continuously developing a pressure gradiant acting axially in the annular space to prevent said solid materials and fluid from moving out of said annular space in a direction opposite the direction the materials are moved axially by said rotating pins.

37. A method of mixing particulate materials comprising:
feeding solid materials to be mixed substantially radially into an annular space;
concurrently mixing fluid with the materials;
moving the materials axially in the annular space by rotating a series of helically arrayed pins through the annular space to impact, mix and move the solid materials and fluid, arraying said pins in doing so to sweep through substantially the entire volume of said annular space;
continuously developing a pressure gradient acting axially in the annular space to prevent said solid materials and fluid from moving out of the annular space in a direction opposite the direction the materials are moved axially by said rotating pins; and
removing mixed solid materials from said annular space at an adjustably controlled rate.

38. An apparatus for mixing and moving materials comprising:

an enclosure having an inlet through which a substantially particulate material may enter said enclosure, and having an outlet;

fluid injection means for injecting fluid into said inlet for mixing with said particulate material, said fluid injection means, comprising:

a fluid nozzle;

radial adjustment means for adjusting said fluid nozzle radially with respect to said enclosure, said radial adjustment means comprising a plate radially slidable with respect to said enclosure inlet, and defining an opening therethrough for receiving said nozzle;

nozzle axial adjustment means for axially advancing said nozzle toward said inlet and axially retracting said nozzle away from said inlet; and fluid flow adjustment means for adjusting the flow rate of said fluid through said nozzle into said inlet; and material movement means disposed in said enclosure for moving said material from said inlet to said outlet.

39. The apparatus of claim 38 wherein:

said opening in said plate is internally threaded; and said nozzle defines an externally threaded surface;

whereby, when said nozzle is threadingly engaged with said opening, said nozzle is axially adjustable.

40. The apparatus of claim 38 wherein said flow adjustment means is characterized as a pressure source having a variable pressure level.

41. An apparatus for mixing and moving materials comprising:

an elongated cylindrical enclosure having a radially extending inlet at one end thereof through which a substantially particulate material may enter said enclosure by radial movement relative thereto, and having an outlet;

fluid injection means mounted on said inlet for injecting fluid into said inlet for selectively mixing the fluid with said particulate materials, said fluid injection means comprising:

at least one fluid nozzle;

radial adjustment means for adjusting said fluid nozzle in a radial direction toward and away from said cylindrical enclosure;

nozzle axial adjustment means for incrementally advancing said nozzle toward said inlet and toward the path of material flow through said inlet, and for incrementally retracting said nozzle away from said inlet; and fluid flow adjustment means for adjusting the flow rate of said fluid through said nozzle into said inlet; and material movement means disposed in said elongated cylindrical enclosure for moving said material from said inlet to said outlet.

* * * * *